US007781918B2

(12) United States Patent
Crane

(10) Patent No.: US 7,781,918 B2
(45) Date of Patent: Aug. 24, 2010

(54) ELECTRICAL SWITCHING CIRCUIT

(75) Inventor: Jolyon Michael Crane, Christchurch (GB)

(73) Assignee: P G Drives Technology Limited, Christchurch (GB)

( * ) Notice: Subject to any disclaimer, the term of this patent is extended or adjusted under 35 U.S.C. 154(b) by 356 days.

(21) Appl. No.: 11/558,017

(22) Filed: Nov. 9, 2006

(65) Prior Publication Data

US 2007/0108845 A1 May 17, 2007

(30) Foreign Application Priority Data

Nov. 11, 2005 (GB) ..... 0523082.6

(51) Int. Cl.
*H01H 35/00* (2006.01)
*H01H 83/00* (2006.01)

(52) U.S. Cl. ..... 307/116

(58) Field of Classification Search ..... 307/116
See application file for complete search history.

(56) References Cited

U.S. PATENT DOCUMENTS 4,251,845 A 2/1981 Hancock
4,525,762 A 6/1985 Norris
4,598,330 A 7/1986 Woodworth
5,119,261 A 6/1992 Sonntagbauer
6,347,030 B1 * 2/2002 Matsuura ..... 361/166
6,741,435 B1 5/2004 Cleveland
2002/0175656 A1 * 11/2002 Matsunaga et al. ..... 320/128
2003/0196824 A1 * 10/2003 Gass et al. ..... 173/131
2004/0165322 A1 * 8/2004 Crawford et al. ..... 361/2

FOREIGN PATENT DOCUMENTS

EP 0298718 1/1989

* cited by examiner

*Primary Examiner*—Fritz M Fleming
*Assistant Examiner*—Dru M Parries
(74) *Attorney, Agent, or Firm*—Gordon & Jacobson, PC

(57) ABSTRACT

Electrical switch circuitry including a relay with contacts and a transistor. A control circuit switches the transistor ON in response to a voltage difference across the relay contacts reaching a predetermined value, such that in use, electrical current is caused to flow through the transistor while the electrical contacts of the relay are closing or opening. This reduces electrical arcing across the contacts of the relay.

16 Claims, 2 Drawing Sheets

A
$V_{COIL}$

B
6V
$V_{LOAD}$

C

D

E
T

F
T+ΔT

G

ELECTRICAL SWITCHING CIRCUIT

CROSS-REFERENCE TO RELATED APPLICATIONS

This application claims benefits from U.K. Patent Application No. 0523082.6, file on Nov. 11, 2005, the contents of which are hereby incorporated herein by reference.

BACKGROUND OF THE INVENTION

1. Field of the Invention

This invention relates broadly to electrical switching circuits. More particularly, this invention relates to electrical switching circuits that utilize one or more electromechanical relays.

2. State of the Art

Electromechanical relays are a very mature technology. Despite being replaced by semiconductor devices in many applications, the basic relay still retains many advantages over modern switching systems including an inherently low voltage drop and electrical isolation.

The life of the electrical contacts of the relay is usually the limiting factor in determining their incorporation in modern circuits. This is especially true for direct current (DC) applications, where contact erosion takes place. The rated useful life of the relay contacts is often only 1% of the mechanical life, especially where loads which are controlled are inductive (e.g., motor), or have a high in-rush current (e.g., tungsten lamps).

Relays are still widely used in automotive applications as the system voltage for automobiles is relatively low e.g. 12V. At higher voltages, the material from which the relay contacts are made behave differently and contact erosion through arcing during the opening and closing of the contacts becomes more significant. This has for instance been a major hurdle in 42V systems.

SUMMARY OF THE INVENTION

It is therefore an object of the invention to provide an electrical switching circuit which retains the advantages of a relay operation, but which is capable of accurately and repeatedly switching high power systems whilst obviating contact erosion.

In accord with these objects, which will be discussed in detail below, electrical switch circuitry in accordance with a first aspect of the invention includes a relay with contacts and a transistor. A control circuit switches the transistor ON in response to a voltage difference across the relay contacts reaching a predetermined value, such that in use, electrical current is caused to flow through the transistor while the electrical contacts of the relay are closing or opening. This reduces electrical arcing across the contacts of the relay.

Preferably, the relay and transistor are connected in a parallel configuration.

Preferably, the control circuit comprises a pulse generator for generating a pulse for turning ON the transistor for a first predetermined period in response to the voltage difference across the relay reaching the predetermined value.

Preferably, the control circuit comprises a comparator for producing a signal when the voltage difference across the relay contacts reaches the predetermined value.

Preferably, the control circuit further comprises an edge detector for producing an edge detector signal in response to the signal from the comparator, the edge detector signal being used to control the pulse generator.

Preferably, the predetermined value is selected to limit the damage causing arcing across the relay contacts.

Preferably, the predetermined value is in the range 4-8 volts.

Preferably, the control circuit further comprises an inhibitor for inhibiting the pulse generator from generating a pulse during a second predetermined period following the first predetermined period.

Preferably, the electrical switch further includes an electrical current overload protector such as a fuse.

Preferably, the transistor of the electrical switch is a Metal Oxide Semiconductor Field Effect Transistor (MOSFET).

In accordance with a second aspect of the invention, electrical circuitry is provided that includes the electrical switching circuitry in accordance with the first aspect of the invention.

Additional objects and advantages of the invention will become apparent to those skilled in the art upon reference to the detailed description taken in conjunction with the provided figures.

BRIEF DESCRIPTION OF THE DRAWINGS

FIG. 2A illustrates the time-varying voltage signal at node A of FIG. 1; FIG. 2B illustrates the time-varying voltage signal at node B of FIG. 1; FIG. 2C illustrates the time-varying voltage signal at node C of FIG. 1; FIG. 2D illustrates the time-varying voltage signal at node D of FIG. 1; FIG. 2E illustrates the time-varying voltage signal at node E of FIG. 1; FIG. 2F illustrates the time-varying voltage signal at node F of FIG. 1; and FIG. 2G illustrates the time-varying voltage signal at node G of FIG. 1.

DETAILED DESCRIPTION OF THE PREFERRED EMBODIMENTS

Figure 1:
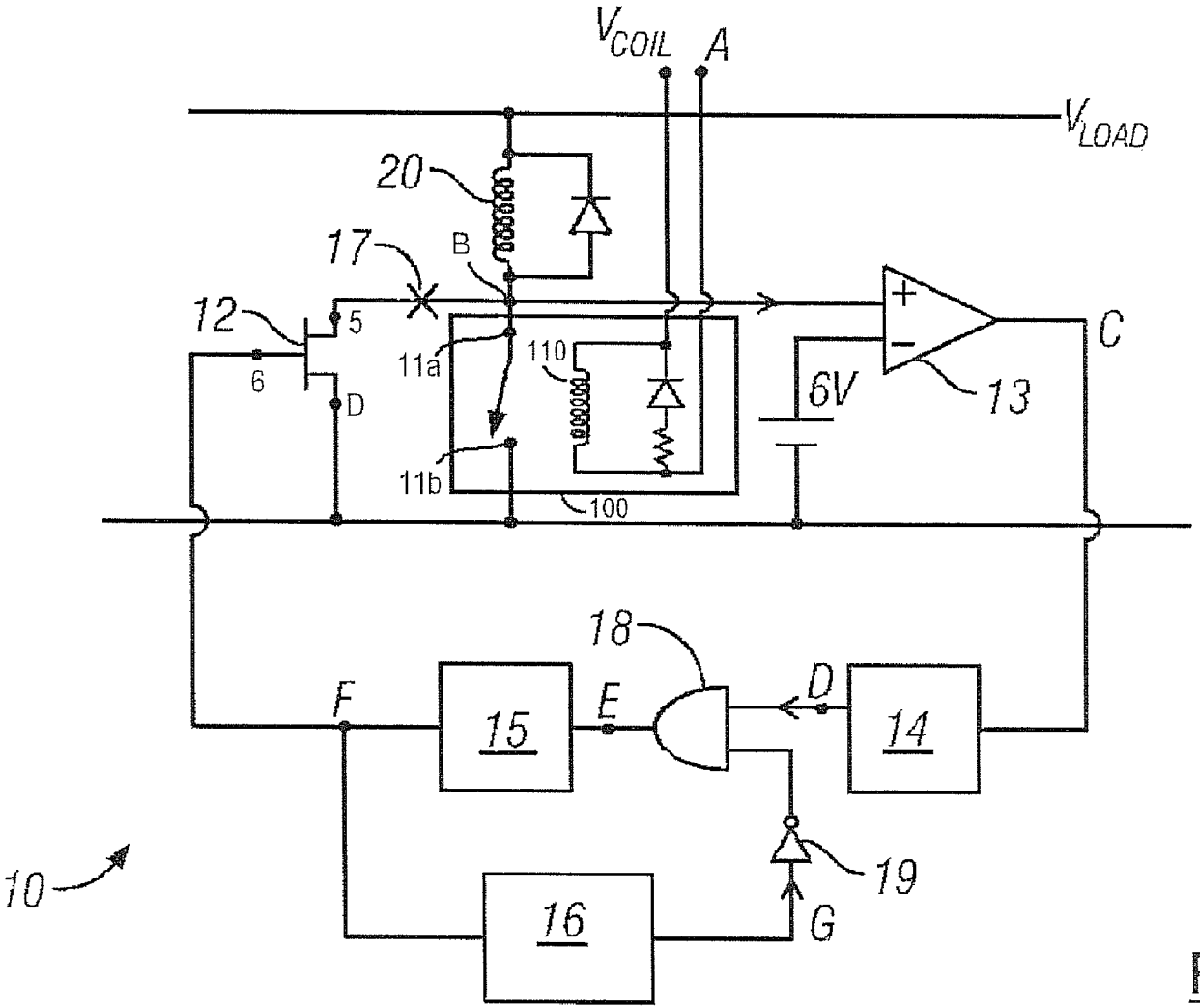
FIG. 1 is a schematic diagram of electrical switching circuitry in accordance with the present invention.

Turning now to FIG. 1, there is shown a circuit 10 comprising an electromechanical relay 100 with contacts 11*a* and 11*b* that are selectively coupled to and decoupled from one another under control of electrical signals supplied to the coil 110 as is well known. For example, in a normally-open type configuration, electrical current flowing through the coil 110 generates a magnetic field that causes the relay contacts 11*a* and 11*b* to close and thus become electrically connected to one another. In the absence of such electrical current, the relay contacts 11*a* and 11*b* are open and thus remain electrically isolated from one another. In a normally-closed type configuration, electrical current flowing through the coil 110 generates a magnetic field that causes the relay contacts 11*a* and 11*b* to open and thus become electrically isolated from one another. In the absence of such electrical current, the relay contacts 11*a* and 11*b* are closed and thus remain electrically connected to one another.

The switchable current path through the relay contacts 11*a* and 11*b* is connected in parallel to the switchable current path of a transistor 12 (e.g., the switchable current path between the source (S) and drain (D) terminals of the FET transistor 12 as shown). A voltage comparator 13 is also connected across the switchable current path through the relay contacts 11*a* and 11*b* and across the switchable current path through the transistor 12. In use, as the relay contacts 11*a* and 11*b* either open or close, the voltage comparator 13 changes voltage state when the voltage difference across the relay contacts 11*a* and

11*b* reaches a predetermined threshold value. This change in voltage state is used to trigger the transistor 12 to momentarily switch on while the contacts 11*a* and 11*b* are opening or closing, to divert current from the relay 100 to the transistor 12 and thereby reduce damage causing arcing across the relay contacts 11*a* and 11*b*. The switching threshold of the comparator 13 is at a voltage greater than the maximum expected voltage drop across the relay contacts, at maximum expected system current. The voltage at which the comparator 13 switches is set by the reference voltage 21 (e.g., 6 volts) and is chosen as a value which ensures that the transistor 12 is switched on before significant contact erosion of the contacts 11*a* and 11*b* can take place through arcing.

An edge detector 14 is connected to the output of the comparator 13. The edge detector 14 is capable of detecting positive and negative going transitions of the comparator 13 output, such that positive and negative transitions of the comparator 13 are used to trigger the pulse generator 15.

The pulse generator 15 switches on the transistor 12, which may be of the MOSFET (Metal Oxide Semiconductor Field Effect Transistor) type, in accordance with a signal from the edge detector 14 (and thus the comparator 13), for a fixed period of time.

A fuse 17 is connected in series with the transistor 12. The fuse 17 protects the transistor 12 from current overload, and is designed such that abnormal circuit current loads will burn the fuse 17, but the very short switch transitions will not.

Figures 2A, 2B, 2C, 2D, 2E, 2F, 2G:
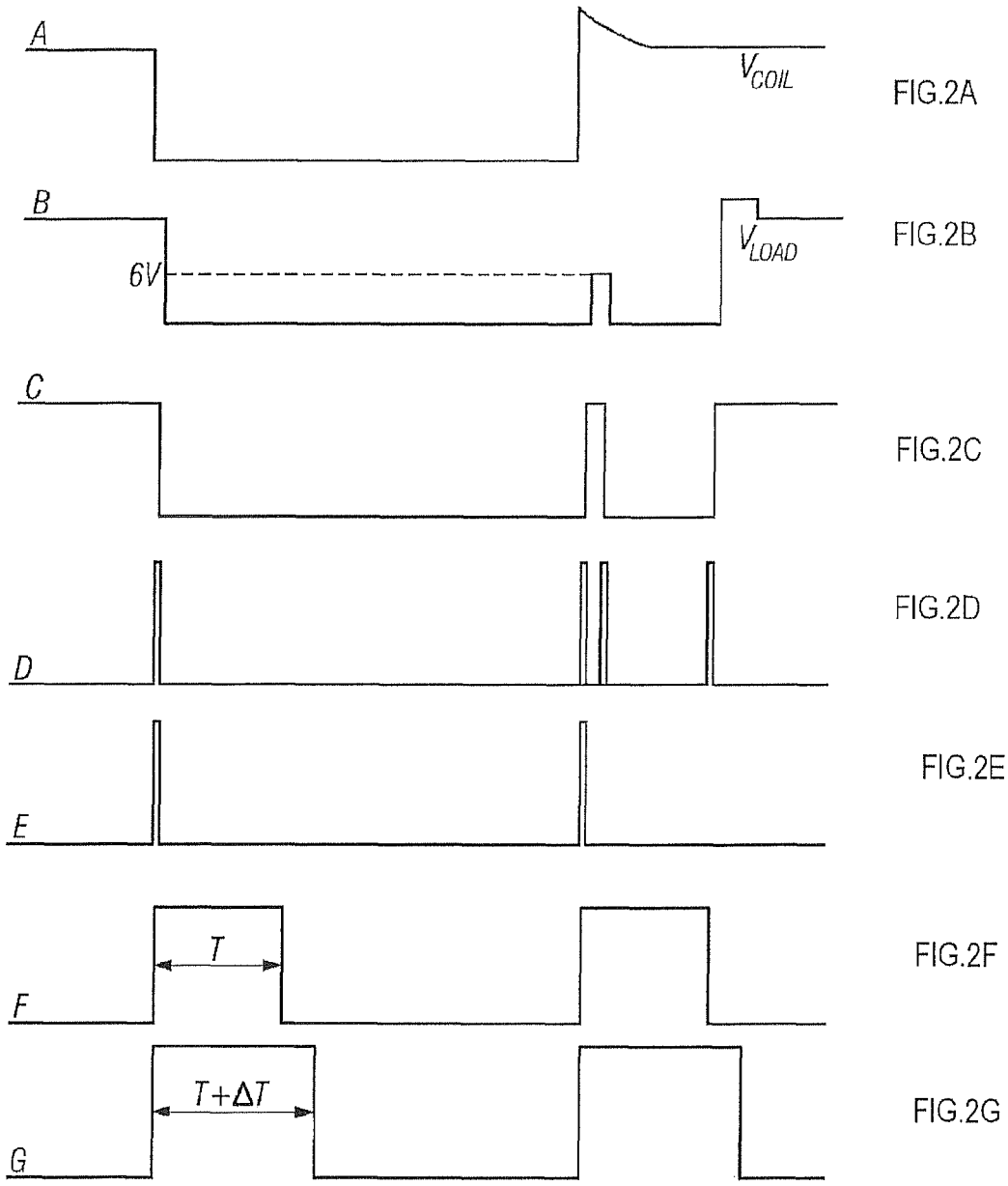
FIGS. 2A-2G, collectively, is a voltage timing diagram illustrating the operation of the electrical switching circuitry of FIG. 1.

Referring to the voltage timing diagrams of FIG. 2, it is assumed that a control signal has been applied between the nodes Vcoil and A in order to drive the coil 110 such that the contacts 11*a* and 11*b* of the relay 100 are open and thus the relay 100 is turned OFF. In this OFF state, current does not flow through the current path between the open relay contacts 11*a* and 11*b* to the load 20. The relay 100 is turned ON by adjusting the control signal applied between the nodes Vcoil and A to drive the coil 110 such that the contacts 11*a* and 11*b* of the relay 100 are closed. In the exemplary embodiment shown, this is accomplished by reducing the voltage at node A as shown in FIG. 2A. The relay 100 switches from the OFF state to the ON state following a short delay due to the rise time of the current through the coil 110. When the relay 100 transitions into the ON state, current flows through the current path between the closed relay contacts 11*a* and 11*b* to the load 20, which induces a voltage drop across the load 20 and thus causes the voltage at node B to fall as shown in FIG. 2B. When the failing voltage level at node B (and hence the voltage difference across the relay contacts 11*a* and 11*b*) reaches a predetermined voltage level (for example, 6V), the comparator 13 will change from a high voltage state to a low voltage state (or vice versa) as shown in FIG. 2C. This transition triggers a pulse from the edge detector 14 as shown in FIG. 2D. The predetermined transition voltage of the comparator 13 can be set to any desired voltage; however, in typical 42V systems a value of 6V is found to cause minimal arcing damage to the contacts 11*a* and 11*b* of the relay 100 while the contacts are opening or closing.

The pulse from the edge detector 14 is transmitted to the pulse generator 15 where a pulse of duration T is generated at node F as shown in FIG. 2F. The pulse at node F is used to switch ON the transistor 12 (e.g., it is supplied to the gate of the transistor 12), which turns on the current path through the transistor 12 and therefore diverts the large current flowing through the relay 11 to protect the relay 11 from the damage causing arcing.

The pulse generated at node F is also passed back to the pulse generator 15 via the timer inhibit 16, a NOT gate 19, and an AND gate 18, the latter of which also has an input from the edge detector 14. The inhibit timer 16 increases the duration of the incoming pulse at node F from T to T+T as shown in FIG. 2G. The output of the pulse generator 16 is used to lock out further trigger inputs into the pulse generator 15 for the period T+T, and thus prevents unwanted oscillations and false triggering of the pulse generator 15.

The relay 100 is then turned OFF by adjusting the control signal applied between the nodes Vcoil and A to drive the coil 110 such that the contacts 11*a* and 11*b* of the relay 100 are opened. In the exemplary embodiment shown, this is accomplished by increasing the voltage at node A as shown in FIG. 2A. The relay 100 switches from the ON state to the OFF state following a short delay due to the decay time of the current through the coil 110. When the contacts 11*a* and 11*b* open, the current path through the open contacts is turned off and the load 20 is electrically isolated therefrom, which causes the voltage at node B to rise as shown in FIG. 2B. When the rising voltage level at node B (and hence the voltage difference across the relay contacts 11*a* and 11*b*) exceeds a predetermined value (e.g., 6 volts), the comparator 13 will change from a low voltage state to a high voltage state (or vice versa) as shown in FIG. 2C. This transition triggers a pulse from the edge detector 14 as shown in FIG. 2D. The predetermined transition voltage of the comparator 13 can be set to any desired voltage; however, in typical 42V systems a value of 6V is found to cause minimal arcing damage to the contacts 11*a* and 11*b* of the relay 100 while the contacts are opening or closing.

The pulse from the edge detector 14 is transmitted to the pulse generator 15 where a pulse of duration T is generated at node F as shown in FIG. 2F. The pulse at node F is used to switch ON the transistor 12 (e.g., it is supplied to the gate of the transistor 12) for a period T, which is just long enough for the relay contacts 11*a* and 11*b* to open to produce an air gap sufficient to sustain isolation, and thus, protect the relay 11 from the damage causing arcing.

As the transistor 12 switches on, the voltage at node B will fall again as shown in FIG. 2B. This transition will be detected by comparator 13, whose output triggers a further pulse from the edge detector 14 at node D as shown in FIG. 2D. However, the AND gate 18 and the NOT 19 gate in conjunction with the feedback signal generated by the timer inhibit 16 at node G ensures that this further pulse is not transferred to node E and to the pulse generator 15, which would affect the operation of the transistor 12 (i.e., switch it off).

When the period T of the pulse at node F has expired, the transistor 12 switches off and the voltage at node B rises as shown in FIG. 2B. This transition will be detected by comparator 13, whose output triggers a further pulse from the edge detector 14 at node D as shown in FIG. 2D. However, the AND gate 18 and the NOT 19 gate in conjunction with the feedback signal generated by the timer inhibit 16 at node G ensures that this further pulse is not transferred to node E and to the pulse generator 15, which would affect the operation of the transistor 12.

The electrical switching circuitry as described above thus protects the relay contacts 11*a*, 11*b* from the large currents during the opening and closing of the relay contacts 11*a*, 11*b* by diverting the current at these times through the transistor 12. This technique increases the operational lifetime of the relay and provides for support of larger currents that are outside of the capabilities of the relay 100 itself.

Advantageously, the electrical switching circuitry as described above automatically turns ON the current path through the transistor 12 to coincide with the closing of the relay contacts 11*a* and 11*b*. The synchronization of these operations is robust in that it is not affected by changes to various circuit characteristics such as the relay coil current rise and decay times (which will vary with factors such as construction, drive current and temperature). This property allows the ON period of the transistor 12 to be very short (e.g. <0.5 ms), which is a duration only long enough for the contacts to close. Such short ON period requires that the designer consider the pulse rating of the transistor 12. More particularly, the transistor 12 should be able for short pulse periods while being capable of conducting high currents therethrough.

In an alternative embodiment, the electrical switching circuitry further comprises a monitoring arrangement (not shown) to detect a failure of the fuse 17 or the relay 100. The arrangement is placed between the transistor 12 and the fuse 17 and is used to verify that the voltage across the current path of the transistor 12 is high before the relay coil 110 is energized (or after the pulse generator 15 has finished transmitting the pulse). If this voltage is low, then either the fuse 17 has blown, the load is open circuit or the relay 11 is faulty, i.e. the contacts 11*a* and 11*b* have become stuck. In this case, a serious system failure is detected.

Furthermore, whilst the electrical switching circuitry shown in FIG. 1 illustrates the situation whereby the relay 100 and transistor 12 are arranged on the low voltage side of the load 20, the invention applies equally to the situation in which the relay 100 and the transistor 12 are situated on the high voltage side of a load.

There have been described and illustrated herein several embodiments of electrical switching circuitry and methods of operating same. While particular embodiments of the invention have been described, it is not intended that the invention be limited thereto, as it is intended that the invention be as broad in scope as the art will allow and that the specification be read likewise. Thus, while the invention has been described herein with references to the circuitry shown in FIG. 1, other circuit arrangements could equally incorporate the relay-transistor operation described herein. In addition, while a particular MOSFET type of transistor has been disclosed, it will be understood that other transistor types (such as Insulated Gate Bipolar Transistor (IGBT)) can be used. It will therefore be appreciated by those skilled in the art that yet other modifications could be made to the provided invention without deviating from its spirit and scope as claimed.

What is claimed is:

1. Electrical switch circuitry comprising:

a relay including a coil and first and second contacts to a switchable current path therethrough, the switchable current path controlled by a control signal supplied to the coil;

a first control circuit electrically connected to the coil of the relay, the first control circuit generating the control signal that is supplied to the coil for controlling the switchable current path of the relay;

a transistor defining a current path therethrough, the current path of the transistor electrically connected to the first and second contacts of the relay;

a load electrically connected to one of the first and second contacts of the relay; and a second control circuit, operably coupled to the load and the transistor without electrical connection to the first control circuit, for switching the transistor into an ON state in response to a voltage drop across the load reaching a predetermined value, such that in use, electrical current is caused to flow through the current path of the transistor while the contacts of the relay are closing or opening, thereby diverting current flow away from the contacts of the relay while the contacts of the relay are closing or opening and reducing electrical arcing across the contacts of the relay.

2. Electrical switch circuitry as claimed in claim 1, wherein:

the current path of the relay and the current path of the transistor are connected in a parallel configuration.

3. Electrical switch circuitry as claimed in claim 1, wherein:

the second control circuit comprises a pulse generator for generating a pulse for switching the transistor into the ON state for a first predetermined period in response to the voltage difference across the contacts of the relay reaching the predetermined value.

4. Electrical switch circuitry as claimed in claims 3, wherein:

the second control circuit comprises a comparator for producing a signal when the voltage drop across the load reaches the predetermined value.

5. Electrical switch circuitry as claimed in claim 4, wherein:

the second control circuit further comprises an edge detector for producing an edge detector signal in response to the signal from the comparator, the edge detector signal being used to control the pulse generator.

6. Electrical switch circuitry as claimed in claim 1, wherein:

the predetermined value is selected to limit the damage causing arcing across the contacts of the relay.

7. Electrical switch circuitry as claimed in claim 6, wherein:

the predetermined value is in the range between 4 and 8 volts.

8. Electrical switch circuitry as claimed in claim 3, wherein:

the second control circuit further comprises an inhibitor for inhibiting the pulse generator from generating a pulse during a second predetermined period following the first predetermined period.

9. Electrical switch circuitry as claimed in claim 8, wherein:

the inhibitor comprises time inhibit circuitry for generating a long duration pulse encompassing both the first predetermined period and the second predetermined period and logic that controls the pulse generator based upon said long duration pulse.

10. Electrical switch circuitry as claimed in claim 9, wherein:

said logic comprises a NOT gate and an AND date, the NOT gate inverting the output of the time inhibit circuitry, the output of the NOT gate provided as an input to the AND gate, and the output of the AND gate provided as an input to the pulse generator for controlling the pulse generator.

11. Electrical switch circuitry as claimed in claim 10, wherein:

the second control circuit comprises a comparator and an edge detector, the comparator for producing a signal when the voltage drop across the load reaches the predetermined value, the edge detector for producing an edge detector signal in response to the signal from the comparator, the edge detector signal provided as an input to the AND gate for controlling the pulse generator.

12. Electrical switch circuitry as claimed in claim 1, further comprising:

an electrical current overload protector operably coupled between the relay and the transistor.

13. Electrical switch circuitry as claimed in claim 12, wherein:

the current overload protector comprises a fuse.

14. Electrical switch circuitry as claimed in claim 1, wherein:

the transistor is a Metal Oxide Semiconductor Field Effect Transistor (MOSFET).

15. Electrical switch circuitry as claimed in claim 1, wherein:

the load and contacts are coupled in series to one another, and a voltage signal is supplied to the series-coupled load and contacts.

16. Electrical switch circuitry as claimed in claim 15, wherein:

the voltage signal induced by the load represents a voltage drop across the load of the voltage signal supplied to the series-coupled load and contacts, the voltage drop varying in magnitude when the contacts are closing and opening.

* * * * *